United States Patent [19]

Cogle, Sr.

[11] Patent Number: 4,783,933

[45] Date of Patent: Nov. 15, 1988

[54] METHOD OF ABRADING WOVEN MATERIAL WITH THE PITS (ENDOCARP) OF THE GENUS PRUNUS FRUIT (DRUPE)

[76] Inventor: Jerry W. Cogle, Sr., Rte. 1, Box 404, Inwood, W. Va. 25428

[21] Appl. No.: 96,057

[22] Filed: Sep. 14, 1987

[51] Int. Cl.[4] ..... B24B 1/00

[52] U.S. Cl. ..... 51/313; 51/303

[58] Field of Search ..... 51/313, 303, 304, 305

[56] References Cited

U.S. PATENT DOCUMENTS 2,622,047 12/1952 Ayers ..... 51/303

4,575,887 3/1986 Viramontes ..... 51/313

*Primary Examiner*—Frederick R. Schmidt

*Assistant Examiner*—Maurina Rachuba

[57] ABSTRACT

In this method of abrading woven material in a washing machine, the woven material is placed in the washing machine. A predetermined amount of abrasive unaltered mature pits are added to the washing machine. The washing machine is operated in the run mode for a predetermined time. The abraded woven material and the abrasive pits are removed from the washing machine.

1 Claim, No Drawings

METHOD OF ABRADING WOVEN MATERIAL WITH THE PITS (ENDOCARP) OF THE GENUS PRUNUS FRUIT (DRUPE)

BACKGROUND OF THE INVENTION

This invention relates to a method of abrading woven material in a washing machine. More particularly the method of the invention relates to what is commonly known to the laundry industry as "stone washing."

Current methods of abrading woven material include pumice stone, synthetic stone, and sand particles. In the pumice stone method, pumice stones are placed in the compartment of the washing machine along with the woven material and agitated until the desired abrasion is achieved. Several significant problems occur with the pumice stone method. First, the pumice stones erode and create a gritty residue that is damaging to the mechanical apparatus. This gritty residue clogs the drainage system and damages the drain valves. The gritty residue also infiltrates the woven material, causing some damage to the woven material. The erosion factor is also extremely costly.

The synthetic stones have a distinct problem in that they are much too heavy.

SUMMARY OF THE INVENTION

The invention eliminates all of the aforementioned problems of the existing methods. In summary, after the woven material is placed in the washing machine capable of being agitated. A predetermined amount of the unaltered mature pits, are added to uniformly abrade the woven material. The woven material and abrasive pits are then removed from the washing machine and the woven material is separated from the abrasive pits. The pits will be reused in further abrading operations.

Thus, the method of the invention exposes the woven material to the abrasive pits, of the Genus Prunus fruit, because the size is such that the pits will remain in the compartment. The pit of the Genus Prunus fruit does not show any sign of wear or erosion over numerous times of continuous use, showing only a 1% loss factor, and the pits precipitate no residue.

The fact that the invention involves a bio-degradable, organic material means that waste water treatment plants will be able to effectively handle the material without damage to the treatment systems. Also, the pits of the Genus Prunus fruit, being an organic material and bio-degradeable, will be safer to be handled by the workers at all points of the abrading process, with this invention.

Further, the pits of the Genus Prunus fruit, in many cases, are considered a by-product of the fruit industry which would indicate a cheaper cost per pound. The fact that a yearly average of 1,400,000,000 pounds of peaches alone is processed in the United States would indicate a renewable source of available pits for abrading woven material. The pits of other species of the Genus Prunus fruit would also be a renewable source that may be available for abrading operations.

DETAILED DESCRIPTION OF THE PREFERRED EMBODIMENT

In the preferred embodiment of the present invention, a 900 pound capacity washing machine, consisting of four compartments and, is utilized. However other commerical or household mechanical apparatuses may be used. Any inner perforated cylindrical compartment capable of retaining and agitating the woven material and abrasive pits should work. While the method described herein is not limited to only denim jeans, denim jeans will be used as the example. Any woven material can be abraded by using the following method by varying the quantities of the ingredients and the agitation run time.

Initially forty-eight pairs of denim jeans are placed in each inner perforated cylindrical compartment.

The washing machine is functioned in the run mode, allowing the inner cylindrical compartments to rotate which in turn allows the agitation of the denim jeans.

75 pounds of unaltered mature pits are added to each compartment. The amount of unaltered mature pits may vary by the weight of the woven material, the quantity of woven material added to each inner cylindrical compartment and the abrasion to be achieved. The machine is operated in the run mode to agitate both the woven material and the abrasive pits.

As stated, in the preferred embodiment example, pits are utilized.

While the foregoing is illustrative of the preferred embodiments of the invention, it is clear that other modifications may be possible within the scope of the invention.

I claim:

1. A method of abrading woven material to produce worn effects, comprising the steps of:

placing a quantity of woven material into a compartment of a washing machine;

adding a quantity of unaltered mature fruit pits of the Genus Prunus fruit (Drope);

operating the washing machine until the woven material shows the predetermined wear effects.

* * * * *